US009115603B2

(12) United States Patent
Leibowitz et al.

(10) Patent No.: US 9,115,603 B2
(45) Date of Patent: Aug. 25, 2015

(54) MULTIPLE ORGANIC RANKINE CYCLE SYSTEM AND METHOD

(71) Applicant: ElectraTherm, Inc., Reno, NV (US)

(72) Inventors: Hank Leibowitz, San Ramon, CA (US); Hans Wain, Truckee, CA (US); David Williams, Carson City, NV (US)

(73) Assignee: ElectraTherm, Inc., Reno, NV (US)

( * ) Notice: Subject to any disclaimer, the term of this patent is extended or adjusted under 35 U.S.C. 154(b) by 236 days.

(21) Appl. No.: 13/836,442

(22) Filed: Mar. 15, 2013

(65) Prior Publication Data

US 2014/0026574 A1 Jan. 30, 2014

Related U.S. Application Data

(60) Provisional application No. 61/674,868, filed on Jul. 24, 2012.

(51) Int. Cl.

| | |
|---|---|
| ***F01K 23/10*** | (2006.01) |
| ***F01K 25/00*** | (2006.01) |
| ***F01K 7/06*** | (2006.01) |
| ***F01K 13/00*** | (2006.01) |
| ***F01K 25/08*** | (2006.01) |
| ***F01K 23/06*** | (2006.01) |

(52) U.S. Cl.

CPC ..... *F01K 13/006* (2013.01); *F01K 23/065* (2013.01); *F01K 25/08* (2013.01)

(58) Field of Classification Search

None

See application file for complete search history.

(56) References Cited

U.S. PATENT DOCUMENTS

| | | | | |
|---|---|---|---|---|
| 1,781,368 | A * | 11/1930 | Davidson | 60/676 |
| 2,384,587 | A * | 9/1945 | Badenhausen | 60/657 |
| 3,830,062 | A * | 8/1974 | Morgan et al. | 60/618 |
| 4,586,338 | A * | 5/1986 | Barrett et al. | 60/618 |
| 7,637,108 | B1 * | 12/2009 | Langson | 60/616 |
| 7,665,304 | B2 * | 2/2010 | Sundel | 60/671 |
| 8,438,849 | B2 * | 5/2013 | Kaplan et al. | 60/653 |
| 8,544,274 | B2 * | 10/2013 | Ernst | 60/651 |
| 2008/0168772 | A1 | 7/2008 | Radcliff et al. | |
| 2009/0000299 | A1 | 1/2009 | Ast et al. | |
| 2010/0071368 | A1 * | 3/2010 | Kaplan et al. | 60/651 |
| 2010/0263380 | A1 * | 10/2010 | Biederman et al. | 60/651 |
| 2011/0016863 | A1 * | 1/2011 | Ernst | 60/645 |
| 2011/0203278 | A1 * | 8/2011 | Kopecek et al. | 60/660 |
| 2011/0283702 | A1 | 11/2011 | Huber et al. | |

* cited by examiner

*Primary Examiner* — Christopher Jetton
(74) *Attorney, Agent, or Firm* — D. C. Williams

(57) ABSTRACT

Apparatus, systems and methods are provided for the use of multiple organic Rankine cycle (ORC) systems that generate mechanical and/or electric power from multiple co-located waste heat flows using a specially configured system of multiple expanders operating at multiple temperatures and/or multiple pressures ("MP") utilizing a common working fluid. The multiple ORC cycle system accepts waste heat energy at different temperatures and utilizes a single closed-loop cycle of organic refrigerant flowing through all expanders in the system, where the distribution of heat energy to each of the expanders allocated to permit utilization of up to all available heat energy, In some embodiments, the multiple ORC system maximizes the output of the waste energy recovery process. The expanders can be operatively coupled to one or more generators that convert the mechanical energy of the expansion process into electrical energy.

43 Claims, 5 Drawing Sheets

MULTIPLE ORGANIC RANKINE CYCLE SYSTEM AND METHOD

RELATED APPLICATIONS

This application claims priority from the applicants' prior U.S. Provisional Patent Application 61/674,868, filed Jul. 24, 2012, which is hereby incorporated by reference. In this regard, in the event of inconsistency between anything stated in this specification and anything incorporated by reference in this specification, this specification shall govern.

FIELD OF INVENTION

The present invention relates to apparatus, system, and methods of utilizing organic Rankine cycle ("ORC") systems for the generation of power with multiple expanders and a common working fluid.

BACKGROUND

Many physical processes are inherently exothermic, meaning that some energy previously present in another form is converted to heat by the process. While the creation of heat energy may be the desired outcome of such a process, as with a boiler installed to provide radiant heat to a building using a network of conduits which circulate hot water to radiators or a furnace used for the smelting of metals, in many other instances unwanted heat is produced as a byproduct of the primary process. One such example is an automobile internal combustion engine, which provides motive force as well as significant unwanted heat. Even in those processes in which the generation of heat energy is desired, some degree of residual heat typically escapes or remains that can be managed and/or dissipated. Whether generated intentionally or incidentally, this residual or waste heat represents that portion of the input energy which was not successfully applied to the primary function of the process in question. This wasted energy detracts from the performance, efficiency, and cost effectiveness of the system.

With respect to the internal combustion engine ("ICE"), considerable waste heat energy is generated by the combustion of fuel and the friction of moving parts within the engine. ICE efficiency is generally less than 40%; 60% or more of the engine fuel's energy is therefore converted to waste heat energy that is commonly dissipated to the ICE's surroundings.

Automobiles are usually equipped with extensive systems that transfer the heat energy away from the source locations and distribute that energy throughout a closed-loop recirculating system. This recirculating system usually employs a water-based coolant medium flowing under pressure through jackets within the engine coupled to a radiator across which the imposition of forced air dissipates a portion of the undesired heat energy into the environment. This cooling system is managed to permit the engine to operate at the desired temperature, removing some but not all of the heat energy generated by the engine.

As a secondary function, a portion of the heat energy captured by the engine cooling system may be used to indirectly provide warm air as desired to the passenger compartment for the operator's comfort. This recaptured and re-tasked portion of the waste heat energy generated as a byproduct of the engine's primary function represents one familiar example of the beneficial use of waste heat.

Considerable additional waste heat is expelled from the ICE via the engine exhaust system. The byproducts of the combustion, including gasses containing some particulate matter, exit the engine as a result of the pressure differential between the engine's internal pressure and the lower ambient pressure. Considerable heat is also removed from the system in this process. For most ICE applications, however, it is uncommon to use the heat of the engine exhaust system for a secondary purpose. The temperature of the exhaust flow usually exceeds that of the cooling jacket water. However, the proportion of heat energy removed from the engine and/or available for conversion to other purposes via may not be similarly distributed. For example, the total available heat energy in the jacket water may be less than, equal to, or greater than the total heat energy contained in the exhaust gas flow.

In addition to the cooling of ICEs, jacket water cooling systems have been utilized in a number of other industrial applications, including but not limited to compressor heads or other components in which an increase in pressure, internal friction, or other physical phenomena causes an increase in temperature that must be removed from the system for proper operation. In such systems, exhaust gasses may simultaneously be generated by the same device or by an interconnected device or system, such as the source of power for a gas compressor system. In the case of systems that capture radiated energy including but not limited to solar-based systems, jacket water may be used to cool the apparatus. In some cases, this jacket cooling may be in addition to any primary flow of media inside the system that constitutes the primary conversion function of the system, and the heat energy captured by the secondary cooling system may be considered waste heat energy if it is of no use to the primary solar-based system.

Characteristics of the heat sources that affect quality may include but are not limited to its temperature (sufficiency and stability), form (gaseous, liquid, radiant, etc.), the presence of corrosive elements associated with the heat source, accessibility for use, and the duty cycle of availability. Waste heat energy sources are classified by grade according to these characteristics. Prior art ORC systems prefer higher grade sources of heat that are readily accessible, of generally high and stable temperature, are free of contaminants, and are available without interruption. Lower grade sources of heat, particularly those at lower temperatures, are not as desirable and have not been fully utilized by the prior art.

Large internal combustion engines, as another example, are widely used in heavy industry in numerous applications. For example, General Electric's Jenbacher gas engine division produces a full range of engines with output power capabilities ranging from 250 kW to over 8,000 kW. By comparison, a typical mid-class automobile engine produces about 150 kW of usable output power. The Jenbacher engines may be powered by a variety of fuels, including but not limited to diesel, gasoline, natural gas, biogas, and other combustible gasses including but not limited to those produced from landfills, sewage, and coal mines. These engines are frequently employed to drive electric power generators, thereby converting the mechanical energy produced from the energy of combustion into electrical energy.

In operation, these Jenbacher engines generate tremendous amounts of waste heat energy that has historically been dissipated into the environment. In the case of the combined Jenbacher model J316 engine and generator system with a rated electric power output of approximately 835 kW, approximately 460 kW of heat energy is lost (dissipated) in the exhaust gas at an approximate temperature of 950° F. and approximately another 570 kW is lost in the internal cooling system with a typical jacket water coolant temperature of approximately 200° F. Of that 570 kW, approximately 463 kW is suitable for waste heat recovery at sufficient temperature with the remainder of such low grade as to not be practicable for direct conversion. From this data, less than half of the system's energy output is in the desired form (in this case, electric power output from the system generator). In many prior art systems, a substantial portion of the input energy converted to heat will be lost The heat from exhaust gas generally escapes into the atmosphere, and the recirculating jacket water is cooled by an outboard apparatus (such as by large external condensing radiators driven by forced air sources), which consume additional electric power to function and further reduce the efficiency of the system.

Additionally, the dissipation of this waste heat energy into the environment can have deleterious effects. Localized heating may adversely affect local fauna and flora and can require additional power, either generated locally or purchased commercially, to provide additional or specialized cooling. Further, the noise generated by forced air cooling of the jacket water heat radiators can have undesirable secondary effects.

Waste heat energy systems employing the organic Rankine cycle (ORC) system have been developed and employed to recapture waste heat from sources such as the Jenbacher 312 and 316 combustion engines. One typical prior art ORC system for electric power generation from waste heat is depicted in FIG. 1. Heat exchanger 101 receives a flow of a heat exchange medium in a closed loop system heated by energy from a large internal combustion engine at port 106.

For example, this heat energy may be directly supplied from the combustion engine via the jacket water heated when cooling the combustion engine, or it may be coupled to the ORC system via an intermediate heat exchanger system installed proximate to the source of exhaust gas of one or more combustion engines. In either event, heated matter from the combustion engine or heat exchanger is pumped to port 106 or its dedicated equivalent. The heated matter flows through heat exchanger 101 and exits at port 107 after transferring a portion of its latent heat energy to the separate but thermally coupled closed loop ORC system which typically employs an organic refrigerant as a working fluid. Under pressure from the system pump 105, the heated working fluid, predominantly in a gaseous state, is applied to the input port of expander 102, which may be a positive displacement machine of various configurations, including but not limited to a twin screw expander or a turbine. Here, the heated and pressurized working fluid is allowed to expand within the device, and such expansion produces rotational kinetic energy that is operatively coupled to drive electrical generator 103 and produce electric power which then may be delivered to a local, isolated power grid or the commercial power grid. The expanded working fluid at the output port of the expander, which typically is a mixture of liquid and gaseous working fluid, is then delivered to condenser subsystem 104 where it is cooled until it has returned to its fully liquid state.

The condenser subsystem sometimes includes an array of air-cooler radiators or another system of equivalent performance through which the working fluid is circulated until it reaches the desired temperature and state, at which point it is applied to the input of system pump 105. System pump 105 provides the motive force to pressurize the entire system and supply the liquid working fluid to heat exchanger 101, where it once again is heated by the energy supplied by the combustion engine waste heat and experiences a phase change to its gaseous state as the organic Rankine cycle repeats. The presence of working fluid throughout the closed loop system ensures that the process is continuous as long as sufficient heat energy is present at input port 106 to provide the requisite energy to heat the working fluid to the necessary temperature. See, for example, Langson U.S. Pat. No. 7,637,108 ("Power Compounder") which is hereby incorporated by reference.

As a result of the transfer of waste heat energy from the combustion engine to the ORC system, these types of prior art ORC systems serve two functions. They convert this waste heat energy, which would otherwise be lost, into productive power; and they simultaneously provide a beneficial, and sometimes a necessary, cooling or condensation function for the combustion engine. In turn, the ORC system's shaft output power has been used in a variety of ways, such as to drive an electric power generator or to provide mechanical power to the combustion engine, a pump, or some other mechanical apparatus.

ORC systems can extract as much useful heat energy as they can utilize from one or more waste heat sources (often referred to as the "prime mover"), but owing to various physical limitations they cannot convert all available waste heat to mechanical or electric power via the expansion process discussed above. Similar in some respects to the cooling requirements of the prime mover, the ORC system requires post-expansion cooling (condensation) of its working fluid prior to repressurization of the working fluid by the system pump and delivery of the working fluid to the heat exchanger. The heat energy lost in this condensation process, however, represents wasted energy which detracts from the overall efficiency of the system.

Prior art ORC systems capture a portion of the waste heat energy from either the exhaust gas flow or jacket cooling water, or a combination of both, from a prime mover but must discard a portion of the waste heat energy that might otherwise be captured and converted into useful mechanical and/or electrical energy. Some heat energy is distributed within the internal processes of the prior ORC systems, and this heat energy must be recaptured or it will be lost, thereby decreasing efficiency. For example, the prior art includes systems that utilize superheated fluids, including water, and the recuperation process to increase efficiency (see, for example, Kaplan, US 2010/0071368). This approach recaptures heat energy that would otherwise be lost in the post-expansion fluid during condensation and redirects that energy back to the energy transfer components (vaporizers), which heat the system's working fluid.

The prior art also includes, for example, the use of multiple expanders with multiple heat sources (Biederman, US2010/0263380), cascaded expanders (Stinger, U.S. Pat. No. 6,857,268), and other ORC system configurations with multiple working fluids (Ast, 2010/0242476). These types of systems, however, each add structure and processing to the basic ORC cycle in a fashion that consumes or wastes heat energy that could otherwise be utilized in an ORC cycle. These additional structures also add cost to the systems.

Exacerbating the situation is the fact that these and other prior art systems require the use of high grade waste heat. For example, the expanders typically used in these systems require superheated (other than wet) working fluid. As a result, their input temperature requirements are such that high temperature waste heat is required to properly drive the systems.

Further, these and other references teach the use of additional components, including intermediate heat exchangers to transfer heat energy from one portion of the system to another, including between ORC processes that use separate working fluids of possibly different compositions. Such intermediate components add cost and cause the system to operate at reduced efficiency compared to what can be attained without them.

Further, the use of cascaded heat transfer subsystems necessary to accommodate multiple working fluids decrease the exergy, or the heat energy, recovered from the prime mover that is available for use by the ORC. These types of heat transfer subsystems also increase the cost, complexity, and size of the ORC waste heat recovery system while decreasing reliability and requiring greater maintenance.

Some prior art combined prime mover/ORC engine applications have utilized heat generated by the ORC condensation process in a conventional ORC system condenser while simultaneously providing power (electrical and/or mechanical) for various purposes. Combined heat and power ("CHP") ORC systems have typically fulfilled a secondary purpose by using a portion of the heat energy from the prime mover and/or heat energy remaining in the post-expansion working fluid. FIG. 5 depicts a prior art ORC system including combustion engine heat energy output port 501 and condenser heat energy output port 502.

In one prior art ORC application, residual heat extracted from a dedicated ORC condenser during the cooling of post-expansion ORC working fluid at condenser heat energy output port 502 is used to provide domestic hot water, radiant heating, or both. This process uses a conventional ORC condenser system well known in the art. The energy flow of one such application is depicted in the block diagram of FIG. 6. In this application, a heat generating engine 601 is operatively coupled to electric generator 602 and provides waste heat energy 603 to the ORC system 604. In turn, the ORC system 604 is operatively coupled to drive electric generator 605. Heat energy from the prime mover 601 is delivered to heat energy output port 501 and, in some prior art systems, is extracted to a first heat energy input port 606 (such as for radiant heating); in addition, heat energy from the ORC condenser is delivered to a second heat energy input port 607 (such as for hot water heating). In those ORC systems known by the applicants, the utilization of residual heat from the post-expansion working fluid is intentionally extracted from the system but is not utilized for further system optimization of the prime mover or, for example, for heating a production material such as microorganisms to generate biofuel.

As noted above, screw and twin screw expanders have long been utilized in many applications in the prior art. Certain of these types of expanders have long been capable of operating with wet (i.e., non-superheated) working fluid. As a result, these types of expanders have also long been utilized with heat sources and working fluid temperatures well below the comparable temperatures provided by high temperature heat sources and the superheated working fluid developed in the associated ORC and its expander as a result.

BRIEF SUMMARY OF SOME ASPECTS OF DISCLOSURE

The applicants have invented apparatus, systems and methods that generate mechanical and/or electrical power from multiple waste heat flows using a system of multiple expanders operating at multiple temperatures and/or multiple pressures ("MP") utilizing a common working fluid.

In certain embodiments of the system, two expanders are utilized. This two-expander MP ORC system is a dual-pressure, or two-pressure ("2P"), configuration. In certain embodiments of a 2P system, one expander operates in a high-pressure ("HP") ORC cycle and the second expander operates in a low-pressure ("LP") ORC cycle. Both ORC cycles utilize a common working fluid comprising an organic refrigerant or other suitable substance.

In some applications, multiple heat sources can provide input energy and may originate from a single prime mover, such as, for example, the jacket cooling water and exhaust flow from an internal combustion engine. The ORC heat input may also be provided by two or more prime movers, such as multiple ICEs and/or any other suitable sources.

In some applications, differing heat sources can supply heat energy to a closed loop ORC system including multiple ORC's utilizing a wet working fluid, including as the input to and through one or more expanders in the closed loop system. In some systems, this can allow use of the closed loop ORC system to recover energy from one or more heat sources that will not superheat the ORC working fluid in one or more expanders. In turn, this allows the ORC to avoid use of at least one superheater or recuperator, with the associated cost and heat energy loss of such systems.

In some embodiments, at least one of the expanders is screw expander capable of being driven by wet working fluid. Some instances of the screw expander constitute a twin screw expander. In some instances, the closed loop ORC system includes at least two ORC's, each of which have a screw expander operable with wet working fluid. In some of these embodiments, the screw expander is a twin screw expander.

In some embodiments, the MP ORC system accepts waste heat energy at different temperatures. In certain embodiments, the MP ORC system utilizes a single closed-loop cycle of organic refrigerant flowing through up to all expanders in the system. In some instances, the distribution of heat energy to each of the expanders is allocated and controlled to utilize more, and, when desired, up to and including all available heat energy and increase or maximize the power output of the waste energy recovery process. One or more of the expanders may be operatively coupled to one or more generators that convert the mechanical energy of the expansion process into electrical energy.

The prime mover of some embodiments can be any system, apparatus, or combination of apparatus that converts some or all of its input energy into heat energy or waste heat energy in a form and quantity sufficient for use by one or more MP ORC system(s). In some embodiments, the principal or only purpose of the prime mover can be to generate heat for the MP ORC system(s). Any heat energy sources co-located, compatible for use with, and utilizable by one or more MP ORC system(s), fall within the scope of the term "waste heat" for the purpose of this application.

In some systems, a prime mover can generate and deliver mechanical power to an electric or other power generator in addition to providing waste heat energy for the MP ORC system(s). In certain embodiments, a prime mover can simultaneously generate more than one form of waste heat, such as, for example, cooling water, hot exhaust gas, or radiated heat.

In some embodiments, a suitable prime mover can be a gas compression system in which one or both of the compressor and a system that cools a compressed gas line or reservoir may serve as sources of waste heat energy for the MP ORC.

In some systems, the waste heat recovery system(s) include one or more power generating system, which can be MP ORC system(s), and one or more power receiving components, which can be but are not limited to electric power generator(s), prime mover(s), pump(s), combustion engine(s), fan(s), turbine(s), compressor(s), and the like. The rotational mechanical power generated by the power generating system(s) can also be delivered to the power receiving components.

Waste heat energy may be captured and provided to the MP ORC system in any practicable manner, either directly or via one or more intermediate heat exchanger systems.

In some embodiments, the prime mover can include one or more devices used in an industrial application, such as, for example, electrical power generation, industrial manufacturing, gas compression, gas or fluid pumping, and the like.

In some embodiments, one or more prime movers provide waste heat energy to one or more MP ORC systems, each of which include multiple ORC cycle operating at different pressures. The heat energy is transferred from the prime mover(s) to the MP ORC system(s) via one or more heat exchanger subsystem(s). The heat exchanger subsystem(s) can utilize any practicable method of heat transfer and/or media, such as, for example, water, oil, refrigerant, air, radiation, convection, direct contact, and the like.

In certain embodiments, a single heat exchanger subsystem may be employed for an MP ORC system, a prime mover, a source of heat energy from each prime mover, or for more than one MP ORC system, prime mover, or heat energy source. Such heat exchanger subsystems can have separate inlets and separate outlets for the energy source(s) or a single inlet and/or outlet may be utilized for more than one source.

In certain embodiments, one or more MP ORC systems has a closed loop cycle to prevent intermixture of working fluid between MP ORC systems. In some instances, one more prime movers operates with a separate closed loop jacket water cooling system to prevent any intermixture of jacket water between the prime mover(s) and another system such as an MP ORC system.

In some embodiments, an exhaust gas heat recovery subsystem may be employed to recover waste heat energy from more than one prime mover and convey such heat energy to more than one associated MP ORC system. In some embodiments, a heat recovery subsystem may receive heat energy input from one or more sources and/or provide heat energy to more than one MP ORC system.

In some embodiments, an internal combustion engine generating sufficient waste heat energy in the form of jacket cooling water and exhaust gas provides the energy to separate heat exchanger subsystems coupled to a 2P ORC system. The heat energy can be applied in prescribed amounts to one or both of the two ORC cycles within the 2P ORC system, with the two ORC cycles operating at different pressures. In some such embodiments, up to all of the available waste heat energy may be utilized to the fullest extent possible for conversion to mechanical energy by an expander and/or, by operative connection to a generator, into electrical energy.

In some embodiments, the heat energy from more than one prime mover may be coupled to a single MP ORC system. This can be particularly advantageous when a plurality of prime movers are co-located and the available heat energy from a single ICE is insufficient to fully utilize the energy conversion capability of a single MP ORC system.

In some systems, the heat energy from more than one prime mover may be coupled to a plurality of MP ORC systems.

In some applications, one or more MP ORC systems constitute the entire jacket water cooling system for the prime mover(s). In such cases, the MP ORC systems can replace alternative prime mover cooling systems, which consume, rather than generate, power during operation and therefore usually have a significant cost of operation in addition to their cost of installation. Such power-consuming, dedicated prime mover cooling systems can have a significantly larger footprint than an ORC system, and therefore they may require additional physical space at the generation facility. They may also generate noise and unwanted environmental heat pollution as a consequence of operation. Employing one or more ORC systems in lieu of power consuming dedicated prime mover cooling systems, which are net consumers of power under such circumstances, can be economically, physically, and/or environmentally beneficial.

In some embodiments, the MP ORC system(s) provide a portion of the cooling system for the prime mover(s) and operate in conjunction with additional cooling systems. Electric or other power generated by some MP ORC systems can be applied to the operation of said additional cooling systems for the prime mover as well as provide electric or other power for other purposes at the site or elsewhere. This can be particularly advantageous if, for example, the prime mover is configured to solely provide mechanical power output and a commercial source of electric power is not readily available.

In some embodiments, the residual heat energy remaining in the MP ORC system after all recoverable energy has been converted into mechanical and/or electrical energy may be employed for a further purpose, such as, for example, building heating, domestic and/or industrial hot water applications, the heating of bacterial cultures for anaerobic digestion of biodegradable waste materials, or other purpose(s).

In certain systems, the MP ORC system utilizes all or nearly all of the available and recoverable waste heat energy available from the prime mover(s) and converts that waste heat energy into mechanical and/or electrical energy.

Instances of the MP ORC configuration can provide the opportunity to couple additional heat energy input to the system so that higher sustained power output may be realized while simultaneously increasing system efficiency and/or fully utilizing all available waste heat energy.

One advantage of certain disclosed MP ORC systems are their ability to utilize waste heat energy from multiple sources, such as, for example (meaning herein, without limitation), from sources of different temperatures and of differing quality.

The flexibility afforded by the use of certain multiple ORC cycles and some methods of calculating the required distribution of heat energy from multiple sources of varying grades between the ORC cycles can permit some systems to be optimized for a specific application within a wide range of possibilities.

An additional advantage of some disclosed MP ORC systems is that they can permit up to all or nearly all of the available and recoverable waste heat energy available from one or more sources to be utilized to a greater and, in some embodiments, the fullest extent possible within the physical limitations of the ORC process described in detail below. By more fully utilizing more or up to all available and recoverable waste heat energy, the MP ORC system provides improved, and in some instances, the greatest possible conversion efficiency and economic return.

An additional advantage of certain MP ORC systems is that, by more fully utilizing the waste heat energy from one or more sources, such as for example but not limited to the jacket cooling water from an ICE, the need for additional cooling systems can be significantly reduced or even eliminated. In the prior art known to the applicants, it has been necessary to dissipate remaining available heat energy from sources that cannot be fully utilized by the ORC; that is, available heat energy not captured and converted by the ORC system has been be cooled via secondary means, such as, for example, via use of radiators. These systems not only require considerable space and expense, but they typically consume significant electric power to drive the fans that provide the necessary cooling. As at least some MP ORC systems can fully extract all or nearly all available and recoverable heat energy from its sources, such systems can provide the dual function of generating electric power while obviating the need to consume, e.g., electric power as required in the present art to provide the necessary cooling.

The foregoing is a brief summary of only some of the novel features, problem solutions, and advantages variously provided by the various embodiments. It is to be understood that the scope of an issued claim is to be determined by the claim as issued and not by whether the claim addresses an issue noted in the Background or provide a feature, solution, or advantage set forth in this Brief Summary. Further, there are other novel features, solutions, and advantages disclosed in this specification; they will become apparent as this specification proceeds.

BRIEF DESCRIPTION OF THE DRAWINGS

Without limiting the invention to the features and embodiments depicted, certain aspects this disclosure, including the preferred embodiment, are described in association with the appended figures in which.

DETAILED DESCRIPTION OF THE PREFERRED AND OTHER EMBODIMENTS

Figure 2:
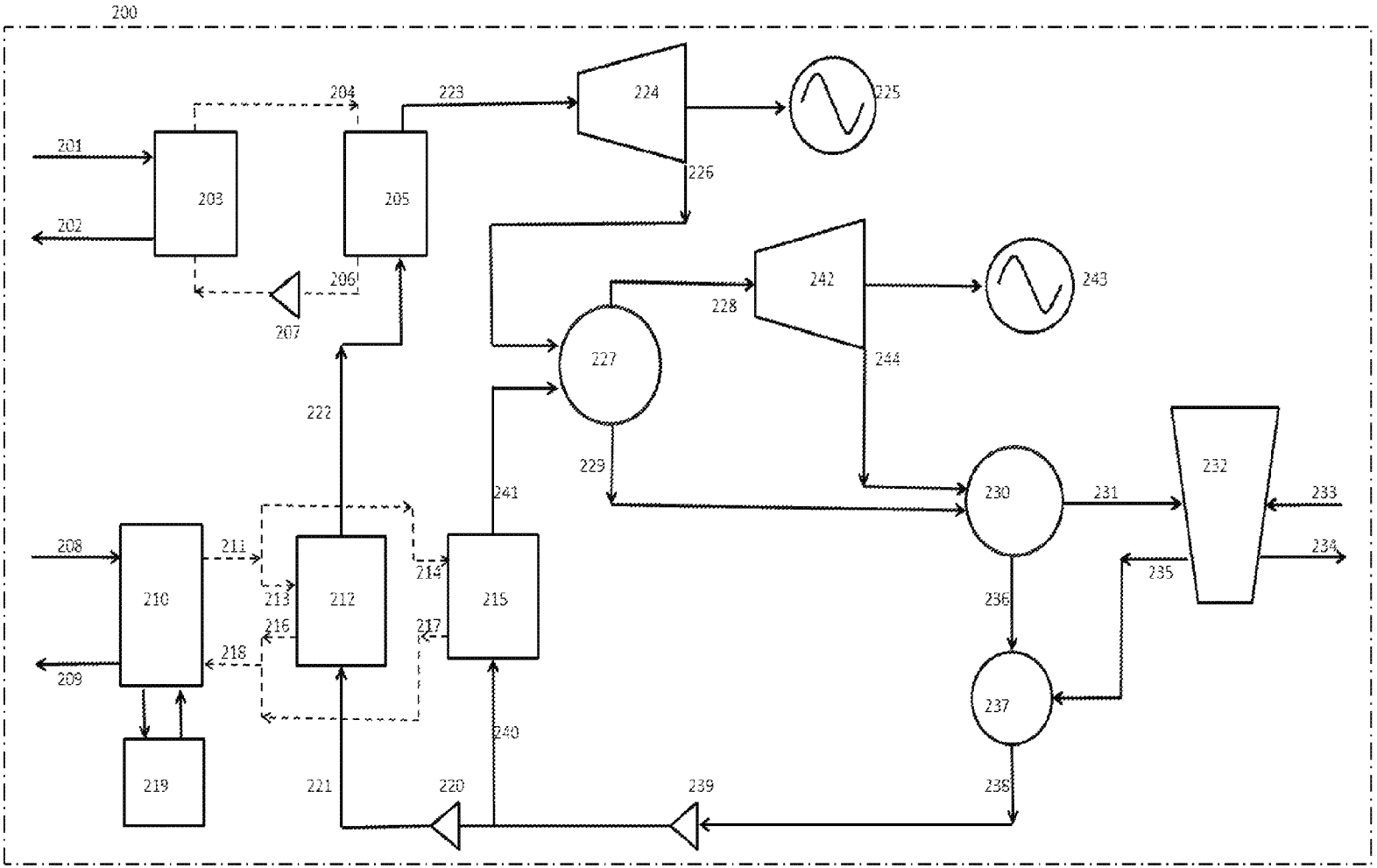
FIG. 2 is a block diagram of an embodiment of a 2P multi-pressure ORC system with two expanders.

FIG. 2 depicts a multi-pressure ORC system 200 that utilizes two expanders 224, 242 operating at different pressures. This configuration is an embodiment of a dual-pressure or 2P ORC system.

By way of example and not limitation, this embodiment as described is suitable for use with a J316 ICE engine, as specified and manufactured by the Jenbacher Gas Engine division of General Electric Energy, as the prime mover. Those skilled in the art will recognize that different configurations suitable for other applications are clearly envisioned by this invention, such as the use of prime movers including but not limited to ICEs with power outputs ranging from 250 kW to 8,000 kW. In this embodiment, the J316 serves a single prime mover for the 2P ORC system and supplies heat energy from both exhaust gas flow and jacket cooling water.

Heat energy contained in the exhaust gas flow of the prime mover is supplied at 201 to a thermal oil heat transfer subsystem 203 operatively coupled to first high pressure cycle evaporator 205 via a recirculating flow of oil through conduits 204 and 206. Thermal oil heat transfer subsystem 203 may include an exhaust gas heat exchanger such as those manufactured and sold by E.J. Bowman Ltd. of Birmingham, UK. The oil flow through this intermediate heat transfer system is facilitated by a pump 207. Following extraction of up to all of the useful heat energy from the exhaust gas flow, at least to the degree of a desired working fluid temperature increase through the first high pressure cycle evaporator 205, the reduced temperature exhaust gas exits the thermal oil heater subsystem at 202. The first high pressure cycle evaporator 205 may be a brazed plate heat exchanger such as those supplied by GEA Heat Exchangers GmbH of Bochum. Germany.

In this particular embodiment, the temperature of the exhaust gas at 201 is approximately 950° F. and approximately 350° F. at 202. Extracting additional heat energy from the exhaust gas flow would further reduce the temperature at 202, resulting in the condensation and precipitation of certain corrosive agents from the exhaust gas flow that would damage and adversely affect the performance of the system. So-called "bad actor" corrosive agents include residual and largely non-combustible elements and compounds present in the fuel supplied to the prime mover ICE, particularly those found in biogas produced by decomposition of unknown biological and/or other materials. Sulfur is one particularly notorious bad actor, as it may combine to form hydrogen sulfide gas ($H_2S$) or sulfuric acid ($H_2SO_4$). Both are extremely corrosive and toxic and, if allowed to precipitate within the exhaust gas heat exchanger portion of thermal oil heat transfer subsystem 203, would significantly degrade the performance and reduce the operating life of that subsystem. For optimum system performance, it is desirable that these bad actors remain in the vapor state until expelled from the system's exhaust stack.

In one embodiment, the working fluid may be heated by any different form of intermediate heat transfer system. In one embodiment, the working fluid may be heated directly by the exhaust gas without the use of an intermediate heat transfer system such as thermal oil heat transfer subsystem 203. For example, the working fluid may be directed through conduits and manifolds directly exposed to the high temperature exhaust gasses, thereby heating the working fluid directly without the use of intermediate media such as oil.

In one embodiment, the temperature of working fluid as heated by high pressure cycle evaporator 205 does not exceed the saturation temperature of the working fluid vapor. One common type of working fluid, (Genetron R-245fa), has a saturation temperature of approximately 280° F. at a pressure of 390 psia. High pressure cycle evaporator 205, such as the GBS series of brazed plate heat exchangers manufactured and sold by GEA Heat Exchangers GmbH of Bochum, Germany, can be used in this embodiment to heat this particular working fluid to 280° F. at a pressure of 390 psia. As the amount of heat energy transferred to the working fluid increases to a point, the enthalpy of the working fluid will increase and the proportion of vaporized working fluid to liquid working fluid will increase, but the temperature will not exceed 280° F. at a pressure of 390 psia. If the system pressure is increased without adding any additional heat energy, the working fluid temperature will increase but the fluid maintains a constant enthalpy. Similarly, if the system pressure is decreased adiabatically, the working fluid temperature will decrease but the fluid will maintain a constant enthalpy. Were a superheater to be employed to transfer sufficient additional heat energy to the working fluid, the enthalpy of the heated working fluid would continue to increase until the working fluid in this example would eventually be completely vaporized and its temperature would then begin to exceed 280° F. at the pressure of 390 psia. This process of increasing the enthalpy of the working fluid to a point such that the temperature of the heated working fluid exceeds its temperature of vaporization at the operative pressure is referred to as superheating. However, the 2P ORC system of this embodiment utilizes a wet working fluid throughout and does not require or utilize a superheater or superheated working fluid. Superheating typically requires recuperation to prevent loss of heat energy in the post-expansion working fluid and the elimination of superheated working fluid and the recuperation process represents an improvement over the prior art. The proportion of liquid state working fluid to vapor state working fluid at any point in the system may vary from completely liquid to completely vaporized depending upon the enthalpy and pressure of the working fluid at that point.

Heat energy contained in the jacket cooling water from the prime mover is supplied at inlet 208 to a jacket water distribution subsystem 210, which consists of a series flow control valves such as the D08 series of proportional control valves available from Continental Hydraulics of Savage, Minn. Under the control of microprocessor-based control subsystem 219 such as the DirectLogic series of programmable logic controllers (PLCs) available from Automation Direct of Cumming, Ga., the control valves in the jacket water distribution system outlet 211 provide the requisite amount of heated jacket water to the high pressure cycle preheater 212 at inlet 213 and to the low pressure cycle preheater and evaporator 215 at inlet 214. These preheaters and evaporators may also be those such as the GBS series of brazed plate heat exchangers manufactured and sold by GEA Heat Exchangers GmbH of Bochum. Germany.

In one embodiment, the low pressure cycle preheater and evaporator 215 described above is a single unit. In one embodiment, the low pressure cycle preheater and evaporator 215 comprises two separate units of similar origin and functionality. In one embodiment, one or more separate preheaters and/or evaporators may be used. All of the heated jacket water received at inlet 208 is provided to either inlet 213 or inlet 214. After passing through the high pressure cycle preheater 212 and the low pressure cycle preheater and evaporator 215, the reduced-temperature jacket water is returned via outlets 216 and 217, respectively, to inlet 218 of jacket water distribution subsystem 210 where it is returned to the prime mover via outlet 209 for recirculation. In this embodiment, the temperature of the jacket water at outlet 211 is approximately 195° F. Subsequent to the transfer of heat within the high pressure cycle evaporator 205 and low pressure cycle preheater and evaporator 215, the temperature of the jacket water at inlet 218 is approximately 160° F. The temperature of the jacket water returned to the prime mover at outlet 209 is maintained within the manufacturer's specified range for proper operation of the prime mover. For the Jenbacher 316 ICE, this range is nominally 50° C. (122° F.) to 90° C. (194° F.).

In one embodiment, high pressure cycle preheater 212 heats the working fluid to the saturation temperature of the working fluid at the operating pressure. In one embodiment, high pressure cycle preheater 212 heats the working fluid to a temperature less than the saturation temperature of the working fluid. For example, high pressure cycle preheater 212 may heat the working fluid to a temperature of 280° F. at a pressure of 390 psia or any other temperature between the working fluid temperature at inlet 221 (nominally 90° F.) and 280° F. However, the high pressure cycle preheater 212 can only heat the working fluid to a maximum temperature that, owing to limitations of the heat transfer apparatus and laws of thermodynamics, approaches but may never exceed the maximum temperature of the input flow of heated jacket water at inlet 213, which in the preferred embodiment is approximately 195° F. A further discussion of the difference between the temperature of input heat energy and the maximum temperature of the heated working fluid output (known as the "pinch") is provided below. Heating the working fluid to a greater temperature will necessitate a higher grade of waste heat energy input to jacket water distribution subsystem 210.

Control subsystem 219 is also operatively coupled to a plurality of sensors, control valves, and other control and monitoring devices throughout the 2P ORC system. To maintain clarity of the Figures, these operative couplings are not depicted in FIG. 2 but are well known to those of ordinary skill in the art. The correct allocation of jacket water heat energy is essential for optimization of 2P ORC operation, and the method for determining and accomplishing this distribution as implemented by control subsystem 219 is described more fully below.

Figure 4:
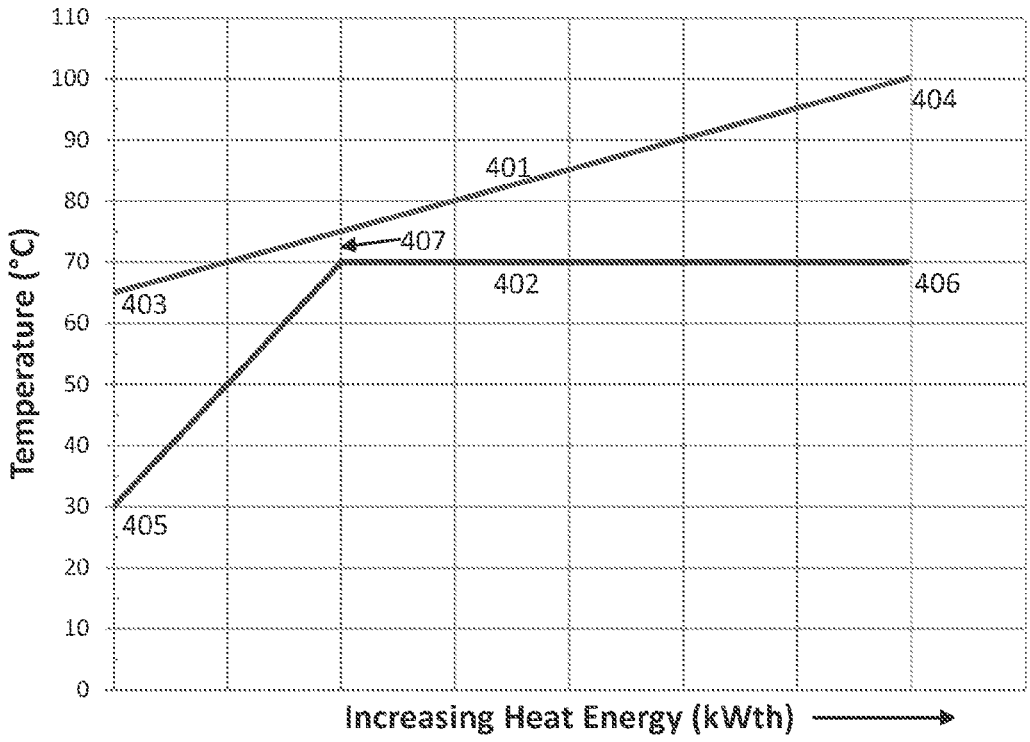
FIG. 4 depicts the temperature versus heat energy of the source and a hypothetical working fluid during the heat energy transfer process from the source to the ORC working fluid in the low pressure cycle of a 2P multi-pressure ORC system.

In one embodiment, 2P ORC system 200 utilizes a single closed loop of working fluid typically comprising a mixture of lubrication oil and organic refrigerant suitable for heating and expansion within the range of temperatures provided by the prime mover. By way of example and not limitation, the refrigerant may be R-245fa, commercially known as Genetron® and manufactured by Honeywell. The performance of the working fluid described in association with FIG. 4 is similar but not identical to R-245fa. However, any organic refrigerant including but not limited to R123, R134A, R22, and the like as well as any other suitable hydrocarbons or other fluids may be employed in other embodiments. In some embodiments, a small percentage of lubrication oil by volume is mixed with the refrigerant for lubrication purposes. Any miscible oil suitable for the intended purpose may be used, including but not limited to Emkarate RL 100E refrigerant lubricant, product number 4317-66 manufactured by Nu-Calgon.

The working fluid is pressurized by centrifugal fluid pumps and variable frequency drive ("VFD") motors 220 and 239 collectively referred to as VFD pumps, operatively monitored and controlled by control subsystem 219. In one embodiment, a single VFD pump may be utilized with suitable valves and controls to serve both ORC cycles. Within the high pressure ORC cycle, VFD pump 220 pressurizes the working fluid to a nominal pressure of 400 psia to cause the working fluid to flow directly through high pressure cycle preheater 212 where it receives heat energy from a portion of the heated jacket water, and then directly to high pressure cycle evaporator 205 where it receives additional heat energy from the exhaust gas flow. The combined heat energy transferred to the working fluid as it passes through these two evaporators causes the working fluid to change state from a heated liquid to a saturated heated vapor. In some embodiments, the heated working fluid may be partially in a liquid state and partially in a vaporized state. The heated and vaporized working fluid is applied to the input of the high pressure cycle expander 224 at an approximate pressure of 390±100 psia and a temperature of 280±25° F. Following expansion, the working fluid flows directly from the expander outlet via 226 at an approximate pressure of 90±30 psia and an approximate temperature of 185±20° F. to a pressurized tank serving as a high pressure cycle separator 227 where any liquid phase portion of the working fluid in equilibrium with the vapor phase portion of the working fluid within the separator may be removed at the bottom. The remaining working fluid in its vapor phase leaves the separator at or near the top and is retained for use in the low pressure ORC cycle, described below, while the liquid working fluid is conveyed directly via 229 to a pressurized tank serving as a low pressure cycle separator 230. In another embodiment, low pressure cycle separator 230 is optional and may be omitted. In such embodiment, low pressure cycle expander outlet 244 may be directly coupled to inlet 231 of condenser subsystem 232 such as the fin fan air cooled condensers available from Guntner U.S. LLC of Schaumburg, Ill., and outlet 229 may be directly coupled via a throttle valve to inlet 231 of condenser subsystem 232.

In some embodiments, condenser subsystem may be a water cooled condenser where cold water input is supplied at inlet 233 and subsequently outlet at 234. In some embodiments, condenser subsystem 232 may be an air-cooled condenser. In some embodiments, condenser subsystem 232 may be utilized to provide heat energy for a desirable secondary purpose, including but not limited to the heating of buildings, domestic or industrial hot water, heating bacterial cultures used for anaerobic digestion of biodegradable waste materials, and the like. In one embodiment, condenser subsystem 232 may be cooled by any suitable alternative means, including but not limited to those utilizing natural environmental resources to dissipate the residual heat energy in the working fluid. The condensed working fluid, now in its liquid state at an approximate temperature of 84° F., is conveyed via outlet 235 directly to working fluid receiver 237 and conveyed via 238 directly to low pressure cycle VFD pump 239. Low pressure cycle VFD pump 239 provides the motive force (nominally 95 psia in this embodiment) necessary to pressurize the low pressure ORC cycle and also provides a portion of the motive force necessary to pressurize the high pressure ORC cycle, the balance of which is provided by high pressure cycle VFD pump 220. In one embodiment, a single VFD pump may provide sufficient motive force for both cycles.

Low pressure cycle VFD pump 239 provides liquid state working fluid via 240 directly to the input of low pressure cycle preheater and evaporator 215, which transfers heat energy from a portion of the jacket water to the working fluid to heat and effect a change of state of the working fluid from liquid to partially or fully vaporized state. The fully or partially vaporized working fluid, at approximate pressure of 90 psia and approximate temperature of 160° F., is then directly conveyed to high pressure cycle separator 227 where it is combined with the partially or fully vaporized working fluid previously expanded in the high pressure cycle expander 224. The partially or fully vaporized working fluid from both sources is applied directly to the inlet 228 of low pressure cycle expander 242 at an approximate pressure of 90±15 psia and approximate temperature of 160°±10° F. Within the expander, the partially or fully vaporized working fluid is expanded, removed at outlet 244 at an approximate pressure of 27 psia and approximate temperature of 113° F., directly conveyed to low pressure cycle separator 230, condenser subsystem 232, and then to VFD pump 239 for repressurization as previously described.

High pressure and low pressure cycle expanders 224 and 242 may be any devices capable of translating a decrease in pressure into mechanical energy, including but not limited to screw-type expanders, other positive displacement machines such as scroll expanders or turbines, and the like. In multi-pressure systems including the 2P ORC system, the expanders may be of similar or different types. In some embodiments, the expanders will be identical machines of the twin screw configuration as taught by Stosic in U.S. Pat. No. 6,296,461. These expanders can be of identical characteristics or may be different.

Such units are available, for example, in the XRV series from Howden Compressors of Glasgow, Scotland. Such expanders utilized in association with the specific temperatures discussed in association with FIG. 204 herein are twin screw expanders and operable with wet (i.e., non-superheated) working fluid from the input through to the output of these expanders. They can thus be operated at much lower temperatures than expanders that require superheated working fluid. They can also be utilized with lower temperature heat sources than those that will superheat typical working fluids such as disclosed herein if the ORC system seeks to utilize up to all of the available heat energy from such a source.

High pressure cycle expander 224 is operatively coupled to electric generator 225, such as the Magnaplus series available from Marathon Electric of Wausau, Wis., so that the mechanical energy produced by expansion of the working fluid may be converted into electric power. Similarly, low pressure cycle expander 242 is operatively coupled to electric generator 243 of similar make and origin. Either or both generators may be coupled to the local power grid for the purpose of delivering electrical energy to the grid.

In some embodiments, either or both of these generators may be used to provide power for local use, particularly when commercial electric power is not available at the location of the prime mover and 2P ORC system. This power may be used for the parasitic loads of the ORC and prime mover, including the numerous pumps and condenser systems often used to support system operation.

The generators may be of the synchronous or asynchronous type, depending upon the particular requirements of the system. In one embodiment, the generators are asynchronous induction machines with their stators operatively coupled to the commercial power grid so that the mechanical energy imparted by the expander to the rotor of the induction machine causes alternating current electric power to be generated and delivered to the commercial power grid.

In one embodiment, the mechanical power from the expander shafts may be coupled to one or more other device or system, including but not limited to the prime mover, a pump, fans, and other power utilizing structure or systems in lieu of being coupled to an electric generator.

From the foregoing, it can be seen that the decrease in pressure of the single working fluid in the 2P ORC system that results from its expansion occurs partially in the high pressure cycle expander 224 and partially in the low pressure cycle expander 242. This distribution and proportion of pressure reduction between the two expanders is one substantial benefit of this invention. As with all physical components, certain operating limitations are imposed on the expanders due to the constraints of fabrication materials, size, and geometry. The prior art does not allow the capture and use of all available heat energy from the prime mover, as is taught in the detailed embodiment described herein, or the heat energy from other prime movers in different applications, for conversion using a single expander and single working fluid or multiple expanders and a shared single working fluid. Attempting to do so would result in the dissipation of wasted heat energy in the ORC system condenser subsystem. By dividing the expansion of highly pressurized working fluid between two expanders, arranged in what can be essentially a series configuration with a precise allocation of the available input heat energy between the two interconnected ORC cycles with a single shared working fluid, better, and in some embodiments the most efficient, operation and output of recovered energy is realized. Additionally, this may also be characterized as an induction configuration with two sources of fully or partially vaporized working fluid supplied to the low pressure cycle expander 242.

Figure 1:
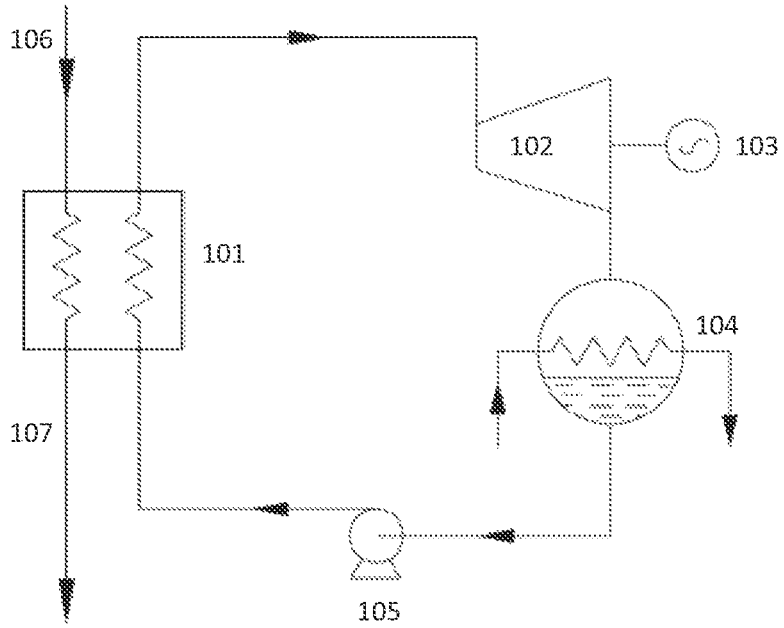
Figure 1 (Prior Art)
FIG. 1 is a block diagram of a prior art ORC system used to convert waste heat energy into electric power.

ORC waste heat recovery systems can be inherently inefficient due to a number of factors. Notably, the physical characteristics of the chosen working fluid can limit the range of temperatures within which the ORC system can effectively convert heat energy via the expansion of pressurized working fluid vapor. Effective heat energy transfer through the heat exchange subsystems, including the thermal oil heat transfer subsystem 203, high pressure cycle evaporator 205, and low pressure cycle preheater and evaporator 215 may each approach 80% only under ideal conditions and may actually yield lower performance than 80%. When cascaded, these sub-unity efficiencies are multiplied and yield an even lower total effective transfer (80% of 80% is 64%). Further, the use of recuperation processes within an ORC system constitute an attempt to recover a portion of excess heat energy that has previously be applied to the system but is not useful for conversion to electrical or mechanical energy and is therefore potentially wasted. As with any thermal process, recuperation is not fully efficient so heat energy is inevitably lost. As a result, in these types of prior art systems much of the available waste heat energy produced by the prime mover is not actually being recovered and transferred to the working fluid. Further, there are significant heat losses within the system due in large measure to the considerable residual heat energy that remains in the post-expansion working fluid and which must be dissipated by the condenser system prior to repressurization by the VFD pump(s). The combined effect of these various losses applied to a prior art ORC system depicted in FIG. 1 that utilize a single twin screw expander, evaporator, and condenser as generally described above along with the same working fluid (R-245fa) can achieve a nominal efficiency of approximately 7% in sustained operation when supplied with the waste heat energy available from a suitable prime mover, such as the Jenbacher J316 in one embodiment taught herein.

Figure 3:
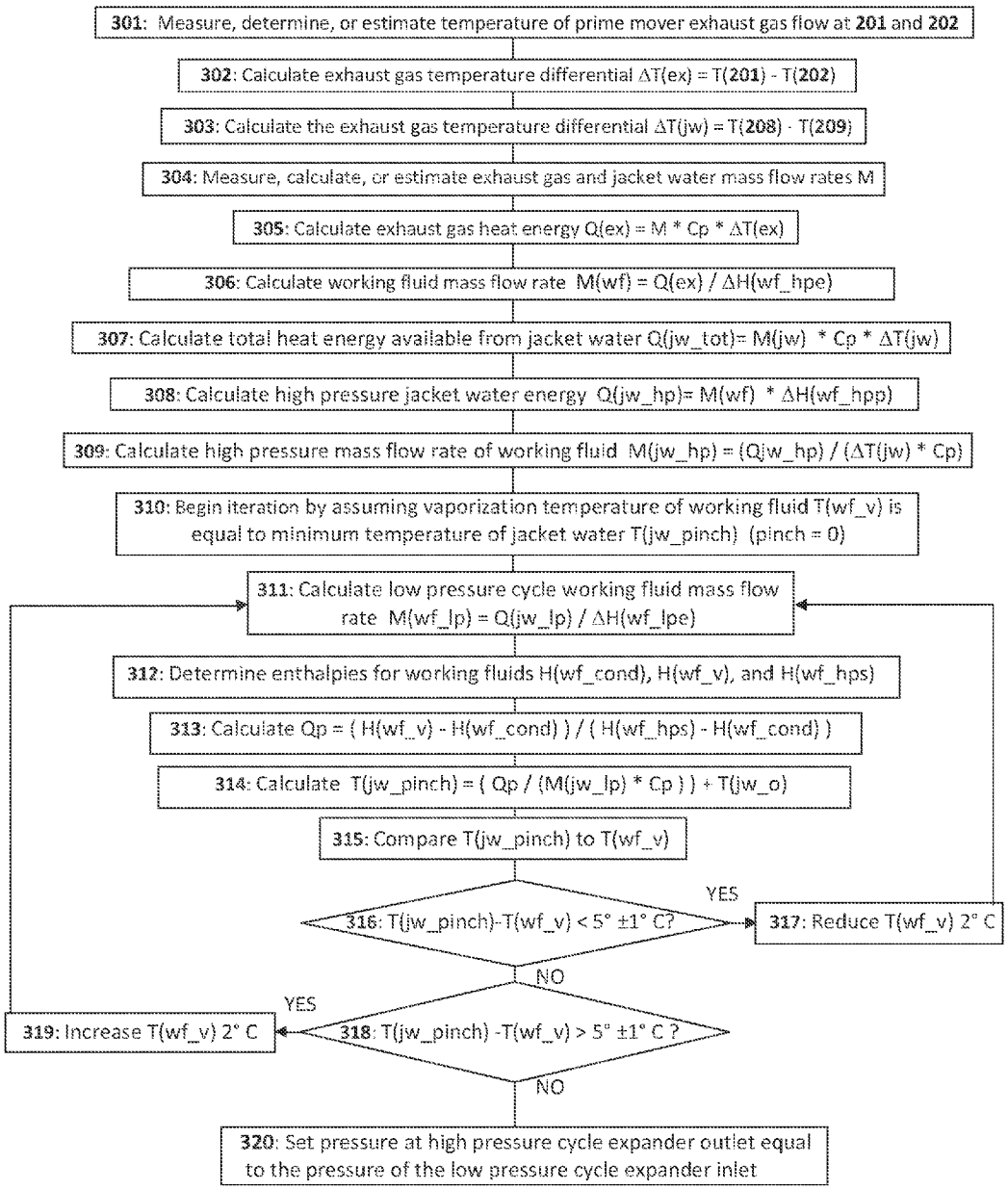
FIG. 3 is a flow chart describing the method in one embodiment of determining the operating parameters for a 2P ORC system.

Embodiments of 2P ORC specified in FIGS. 2-4 and associated text above can improve, and in some embodiments dramatically improve, upon this performance. When supplied with the waste heat energy available from a Jenbacher J316 as the specified prime mover to the particular system identified above, approximately 921 kW of recoverable waste heat energy from exhaust gas above 356° F. and jacket cooling water heat is available for recovery and use by the 2P ORC system. Approximately 458 kW is available from the exhaust gas flow and the remaining 463 kW is present in the jacket water. When all of the available 458 kW of waste heat energy from the exhaust gas flow is provided to the high pressure cycle evaporator 205 via thermal oil heat transfer subsystem 203, 216 kW of available waste heat energy from the jacket cooling water is applied to high pressure cycle preheater 212, and the remaining 247 kW of available waste heat energy from the jacket cooling water is applied low pressure cycle preheater and evaporator 215, the 2P ORC system can produce at least approximately 45 kW of electric power from high pressure cycle generator 225 and another 58 kW of electric power will be produced by low pressure cycle generator 243. The combined 103 kW of electric power generated by the 2P ORC system constitutes an overall conversion efficiency of 11.2% of the waste heat energy of 920 kW available from the prime mover. Accordingly, the 2P ORC system provides an increase of 58% compared to the nominal 7% conversion efficiency of the present art system. This represents a very significant improvement by industry standards.

Additionally, the prior art multiple ORC+superheating systems inherently allocate available heat energy in a fashion that cannot be converted and therefore, in some embodiments, is recovered by the recuperation process to salvage some efficiency. Since, however, the superheating/recuperation process itself imposes substantial energy loss to drive the process, the 2P ORC system specified in association with FIGS. 2-4 is substantially more efficient than these types of processes because all or in any event more available heat is allocated to generating power from the specified closed wet working fluid multiple ORC system.

Another significant advantage of the specified 2P ORC system is its ability to fully utilize up to all of the recoverable waste heat energy available in the jacket water of a suitably-matched prime mover. In prior art systems known to the applicants, only a portion of the heat energy in the jacket water can be utilized and the remainder is cooled through the use of conventional radiators that require additional electric power to operate the cooling fans. In the specified embodiment of this specification, however, the 2P ORC system is combined with waste heat generated by, for example, a widely-used prime mover (such as the Jenbacher J316 internal combustion engine) so that up to all of the available heat energy in the jacket water flow may be fed to the 2P ORC system for waste heat energy conversion into electric power. This can obviate the need for a traditional radiator system to support the prime mover that would consume rather than generate electric power. In addition, a substantial portion of the waste heat in the exhaust gas flow can be captured and converted by the specified 2P ORC system and others disclosed herein. Embodiments of these systems also can reduce and, in some embodiments, minimize thermal pollution of the environment.

The distribution of waste heat energy from each source to each of the two ORC cycles in the 2P ORC system is an operating condition that can be calculated and maintained in order to achieve desired, and in some embodiments, optimal performance. The method of determining the distribution of heat energy between the high and low pressure cycles also overcomes the limitations of the prior art which require heat recuperation from the working fluid to minimize losses and therefore constitutes a significant improvement over the prior art. The method may also be utilized to determine and maintain any desired lesser degree of utilization of available waste heat available from the prime mover at the most efficient point of system operation. In addition the following description, the method of determining the 2P ORC system control and set points is provided as a flow chart in FIG. 3.

The first steps in the iterative method of determining the control and set points for 2P ORC system operation require the computation of the available heat energies in the exhaust gas flow and the jacket cooling water (301, 302). For the exhaust gas, the temperature differential $\Delta T(ex)$ between the exhaust gas flow T(ex_1) at the input 201 and T(ex_2) at the output 202 to the thermal oil heat transfer subsystem 203 may be measured if such apparatus is available for measurement under operating conditions. If said apparatus is not available, the available heat energy from the exhaust gas flow may be determined from the manufacturer's specification data for the prime mover. If neither is available, the values may be estimated based on best available information, recognizing that errors may be introduced by inaccurate estimations and that further refinement and parameter adjustment will likely be required to compensate for difference between estimated and actual values later realized in practice.

For the jacket water, the same temperature differential between T(jw_1) at the input 208 and T(jw_2) at the output 209 of the jacket water distribution subsystem 210 may be measured, calculated, or estimated using best available resources (303).

The mass flow rates M(ex) of the exhaust gas flow and M(jw) of the jacket water flow of the prime mover may be measured, calculated, or estimated based on best available information (304).

The heat energy Q(ex) contained in the exhaust gas is defined as $$Q(ex) = M(ex)\int_{T(ex_2)}^{T(ex_1)} Cp\,dT$$

where Cp is the specific heat of the exhaust gas mixture, which is generally calculated based on the composition of the exhaust gas and dT is the variable of integration. Assuming that the temperature differential is sufficiently low so that Cp may be considered to be constant at its mean value, Q(ex) may be calculated (305) via $$Q(\text{ex})=M*Cp*\Delta T(\text{ex})$$

where ΔT(ex)=T(ex_1)−T(ex_2). The minimum final temperature of the exhaust gas, T(ex_2), is normally set by the engine manufacturer at some safe level above the acid dew point temperature of the gas depending on the fuel used. As previously described, cooling the exhaust gas below the acid dew point will likely cause damage, including corrosion to the engine exhaust system and waste heat recovery heat exchanger.

The temperature of the heated working fluid may approach that of the waste heat source but never be able to reach it due to the limitations imposed by the Second Law of Thermodynamics and the physical limitations of heat exchangers used to transfer the heat from the source to the working fluid. As a principal consequence, the final temperature of the working fluid being heated can never reach the highest temperature of the source being cooled.

FIG. 4 is a general depiction of the heat energy versus temperature of the source heat and working fluid during a heat transfer process at a pressure similar to that which may occur in the low pressure ORC cycle. The data depicted in this figure is illustrative of the performance of some embodiments but is not meant to be an accurate numerical representation of any particular embodiment. However, the properties of the example working fluid closely resemble those of R-245fa Genetron refrigerant which exhibits a saturation temperature of 70° C. at a nominal pressure of 90 psia as may exist at inlet 228 to low pressure cycle expander 242. Line segment 401 represents the source heat and segment 402 represents the working fluid. Point 404 depicts the state of the jacket water at inlet 214 and point 403 represents the state of the jacket water at outlet 217 of low pressure cycle preheater and evaporator 215. In this example, the jacket water experiences a decrease in temperature of approximately 35° C. (from 100° C. to 65° C.). In a similar manner, point 405 represents the state of the working fluid at inlet 240 and point 406 represents the state of the working fluid at outlet 241 of low pressure cycle preheater and evaporator 215. Along this path, it can be seen that the temperature of the working fluid increases from 30° C. to 70° C., which in this example is the temperature at which the working fluid begins to vaporize at the liquid saturation temperature. Although the temperature does not increase beyond this vaporization temperature in this example, the heat energy content of the working fluid continues to increase as it receives additional heat energy from the jacket water and the working fluid is increasingly vaporized.

During this heat transfer process, the paths representing the working fluid heating and jacket water cooling processes do not intersect, lest there be no additional heat transfer between the source and working fluid, in accordance with the Second Law of Thermodynamics. That is, the temperature of the working fluid can never equal that of the waste heat energy input and will always be lower by a certain amount. The temperature at the closest distance between these two paths, point 407, is normally referred to as the "pinch point". It is the minimum temperature difference between the source and working fluid at any point in the heat exchanger. In the design of ORC power plant evaporators, condensers, heat exchangers, and the like, the pinch point is used to determine the pressure, temperature and mass flow of the working fluid leaving the heat exchanger.

In some embodiments, the pinch may be selected to be as low as 3° C. and as high as 10° C. However, the pinch is usually selected by ORC design engineers to be approximately 5° to 10° C. depending on the absolute temperature of the source. The pinch value depicted in the example of FIG. 4 is approximately 5° C. Selection of a larger pinch value reduces system efficiency while selection of a pinch value that is too small increases surface requirements of the heat exchanger and corresponding cost. Since the temperature of the waste heat energy flow decreases as it passes through the evaporator, in the preferred embodiment the working fluid output is in closest contact with the waste heat energy input and the working fluid input in closest contact with the waste heat energy output (counterflow).

In one embodiment, the heat contained in the prime mover's exhaust gas is applied to high pressure cycle heat exchanger 205 either directly or via thermal oil heat transfer subsystem 203, and the design conditions of the high pressure ORC cycle are generally set by the temperature and pressure specifications and limitations of the expander. Those limits are imposed by the heat exchanger's pinch point. In particular, the temperature and pressure of the working fluid heated by the exhaust gas flow may not exceed the rated values for the expander's inlet.

Having determined the heat energy of the exhaust gas and assuming that all of this heat is transferred to the working fluid, the mass flow rate of the working fluid M(wf) may be computed (306) via $$M(wf)=Q(\text{ex})/\Delta H(wf_hpe)$$

where ΔH(wf_hpe) represents the difference in the enthalpy, or total energy, of the working fluid between the high pressure cycle evaporator 205 outlet 223 and inlet 222 which corresponds to a temperature approximately 5° C. below the maximum temperature of the low temperature source. In other words, the working fluid mass flow rate can be determined by the amount of exhaust heat used and by the minimum and maximum enthalpy of the working fluid heated either directly or indirectly (via thermal oil loop) by the exhaust gas.

The total heat energy available from all jacket cooling water is typically provided by the engine manufacturer and also may be calculated (307) via $$Q(jw_\text{tot})=M(jw)*Cp*\Delta T(jw)$$

where ΔT(jw) represents the difference in the temperature of the jacket cooling water between the inlet 208 and the outlet 209 of the jacket water distribution subsystem 210.

As previously described, waste heat energy from the jacket cooling water may be provided to the high pressure ORC cycle via the high pressure cycle preheater 212 that receives a portion of the jacket cooling water from jacket water distribution subsystem 210, depending on the maximum temperature of the jacket water. The amount of jacket water heat energy required for the high pressure cycle may be calculated (308) via $$Q(jw_hp)=M(wf)*\Delta H(wf_hpp)$$

where ΔH(wf_hpp) represents the difference in the enthalpy of the working fluid between the outlet 222 and the inlet 221 to high pressure cycle preheater 212.

The quantity of jacket water provided to the high pressure cycle by jacket water distribution subsystem 210 and control subsystem 219 is determined by the temperature difference of the jacket water circuit as specified by the manufacturer of the prime mover. That mass flow rate may be calculated at the outlet 222 of high pressure cycle preheater 212 (309):

$$M(jw_hp)=(Q(jw_hp)/(\Delta T(jw)*Cp)$$

VFD pump 220 controls the pressure at the input to high pressure cycle expander 224, and via control subsystem 219, the mass flow rate of the working fluid in the high pressure cycle is set to achieve the desired temperature and pressure at the inlet of high pressure cycle expander 224.

The total waste heat energy contained in the jacket water available for the low pressure cycle is the difference between the total jacket water heat available and that already applied to the high pressure cycle preheater 212 as calculated above:

$$Q(jw_lp)=Q(jw_\mathrm{tot})-Q(jw_hp)$$

The temperature and pressure at low pressure cycle expander inlet 228 for optimal system performance may now be determined iteratively via the following method:

1) Assume that the temperature of the vaporized working fluid T(wf_v) is equal to the minimum temperature of the jacket water T(jw_pinch) in the low pressure cycle. This is equivalent to setting the initial value of the pinch in the cycle to zero (310).
2) Calculate the mass flow rate of the working fluid in the low pressure cycle (311) via $$M(wf_lp)=Q(jw_lp)/\Delta H(wf_lpe)$$

where ΔH(wf_lpe) represents the difference in enthalpy of the working fluid leaving the low pressure cycle preheater and evaporator 215 at 241 (where its enthalpy is maximum) and at the entry to the low pressure cycle preheater and evaporator 215 at 240.

3) Using the working fluid property tables, determine the enthalpies (312): a) H(wf_cond) of the working fluid in the low pressure cycle at the outlet 235 of condenser subsystem 232, b) H(wf_v) at the point of initial vaporization (saturated liquid), and c) H(wf_hps) at high pressure cycle separator 227 inlet flow 241.
4) Calculate heat addition at the pinch point Qp (313):

$$Qp=[(H(wf_v)-H(wf_\mathrm{cond}))/(H(wf_hps)-H(wf_\mathrm{cond}))]*Q(jw_lp)$$

5) Because $$Qp=M(jw_lp)*Cp*(T(jw_\mathrm{pinch})-T(jw_o))$$

we may calculate (314)

$$T(jw_\mathrm{pinch})=(Qp/(M(jw_lp)*Cp))+T(jw_o)$$

where T(jw_pinch) is the temperature of the jacket water at the pinch point and T(jw_o) is the temperature of the jacket water at the outlet 217 of low pressure cycle preheater and evaporator 215.

6) Compare (315) T(jw_pinch) to T(wf_v). If the difference is less than 5° C. (316) (the desired pinch value), reduce T(wf_v) by 2° C. (317) and repeat the iteration. If the difference between T(jw_pinch) and T(wf_v) is greater than 5° C. (318), increase T(wf_v) by 2° C. (319) and reiterate.
7) Continue the iteration until the pinch (T(jw_pinch)−T(wf_v)) is 5° C. plus or minus 1° C.

Finally, once the parameters of the low pressure cycle have been determined in this manner, the pressure at the high pressure cycle expander outlet 226 may be set to the pressure of the low pressure cycle expander inlet 228 (320). In one embodiment, one or more control valves or other means of controlling the pressure may be incorporated in the system.

Figure 5:
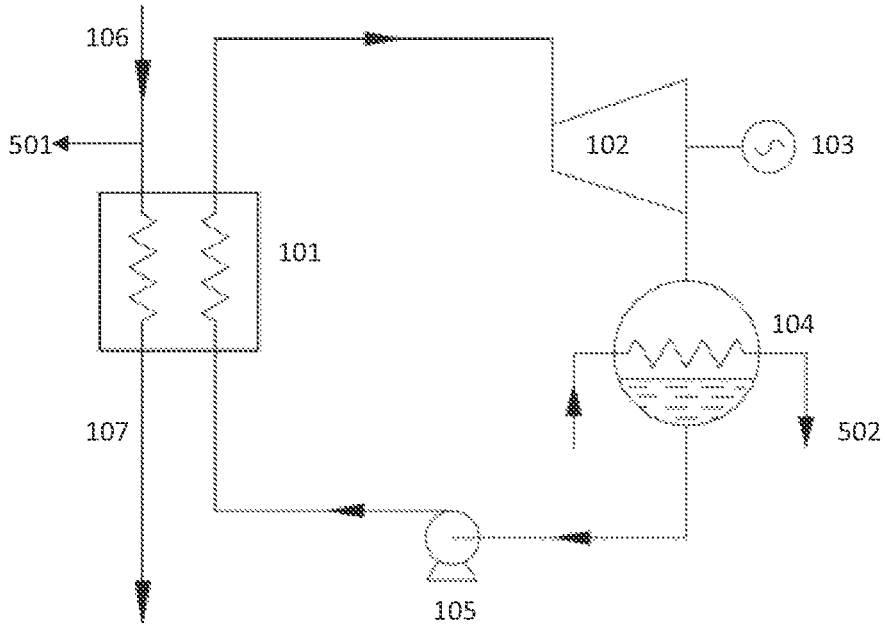
Figure 5 (Prior Art)
FIG. 5 is a block diagram of a prior art ORC system used to convert waste heat energy into electric power including heat extraction ports that can be used to provide heat for other applications.
Figure 6:
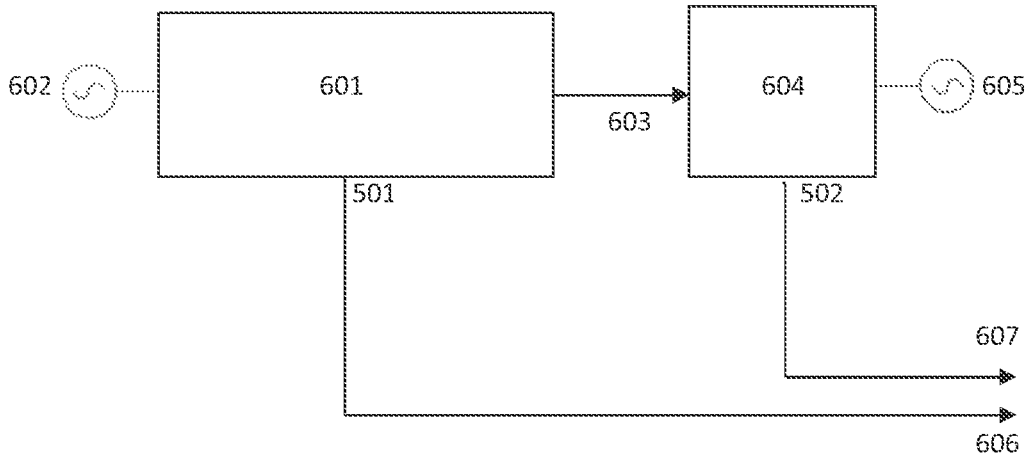
Figure 6 (Prior Art)
FIG. 6 is a block diagram of the energy flow in a prior art system including a prime mover, an ORC system used to convert waste heat energy into electric power, and heat extraction ports for other non-system applications.

With respect to the depiction of heated extraction ports in the prior art systems depicted in FIGS. 5 and 6, the same possibilities exist for MP ORC systems. The condenser subsystem 232 may be replaced, in whole or in part, by an alternate subsystem that utilizes the residual heat energy present in the post-expansion working fluid for any other useful purpose.

The description of this invention is intended to be enabling and not limiting. It will be evident to those skilled in the art that numerous combinations of the embodiments described above may be implemented together as well as separately, and all such combinations constitute embodiments effectively described herein.

The invention claimed is:

1. A system for generating power from heat, the system comprising:

A. a working fluid;

B. a working fluid condenser comprising a working fluid inlet and a working fluid outlet;

C. one or more working fluid pump(s) in working fluid receiving communication with the outlet of the working fluid condenser;

D. two or more source(s) of heat energy;

E. more than two working fluid heat exchangers, each heat exchanger (i) in working fluid receiving communication with at least one of the one or more working fluid pumps and (ii) in heat energy receiving communication with at least one of the two or more source(s) of heat energy such that at least two of said heat exchangers are in heat energy receiving communication with different portions of the same source of heat energy;

F. a first expander comprising (i) a working fluid inlet in working fluid receiving communication with at least one of the more than two working fluid heat exchangers, (ii) a rotating mechanical power output shaft, and (iii) a working fluid outlet;

G. a second expander comprising (i) a working fluid inlet in working fluid receiving communication with the working fluid outlet of the first expander, (ii) a rotating mechanical power output shaft, and (iii) a working fluid outlet in working fluid sending communication with the working fluid inlet of the condenser;

wherein the system is configured to:

a) portion, distribute, and communicate heat energy from the two or more source(s) of heat energy to the working fluid via the more than two working fluid heat exchangers;

b) expand the working fluid in the first expander to generate mechanical power at the rotating mechanical power output shaft of the first expander;

c) further expand the working fluid in the second expander to generate mechanical power at the rotating mechanical power output shaft of the second expander;

d) cool the working fluid in the condenser; and e) communicate cooled working fluid from the condenser to the one or more heat exchangers via the one or more working fluid pumps.

2. The system of claim 1 where in the first expander and the second expander are independently rotatable.

3. The system of claim 1 where the rotating mechanical power output shaft of the first expander is separate from the rotating mechanical power output shaft of the second expander.

4. The system of claim 1 where the rotating mechanical power output shaft of the first expander, the rotating mechanical power output shaft of the second expander, or both of said rotating mechanical power output shafts are in mechanical power output delivery communication with at least one of any of an electric power generator, a prime mover, a pump, a combustion engine, a fan, a turbine, or a compressor.

5. The system of claim 1 such that up to and including all of the heat energy available from at least one of the two or more source(s) of heat energy is communicated to the working fluid.

6. The system of claim 1 further comprising a working fluid receiver disposed between the condenser and the one or more working fluid pumps.

7. The system of claim 1 further comprising a working fluid separator disposed between the working fluid outlet of the first expander and the working fluid inlet of the second expander.

8. The system of claim 1 further comprising a working fluid separator disposed between the working fluid outlet of the second expander and the working fluid inlet of the condenser.

9. The system of claim 1 wherein the first expander operates at a higher pressure than the second expander.

10. The system of claim 1 wherein the system pressure at the working fluid outlet of the first expander is approximately equal to the system pressure at the working fluid inlet of the second expander.

11. The system of claim 1 wherein the system pressure at the working fluid inlet of the first expander is reduced via working fluid expansion in the first expander and further reduced via working fluid expansion in the second expander.

12. The system of claim 1 wherein one or both of the first expander and the second expander are screw expanders.

13. The system of claim 1 wherein the system is further configured to (i) communicate a first portion of heat energy available from a first source of heat energy to the working fluid via a first heat exchanger disposed between at least one of the one or more working fluid pump(s) and the first expander inlet and (ii) communicate a second portion of the heat energy available from the first source of heat energy to the working fluid via a second heat exchanger disposed between at least one of the one or more working fluid pump(s) and the second expander inlet.

14. The system of claim 13 further comprising valves to allocate the heat energy available from the first source of heat energy into the first portion and second portion of heat energy.

15. The system of claim 13 wherein the first portion and second portion of the heat energy from the first source of heat energy comprise in combination up to and including all of the heat energy available from the first source of heat energy.

16. The system of claim 13 such that up to and including all of the heat energy available from the first source of heat energy is communicated to the working fluid.

17. The system of claim 13 wherein the first source of heat energy is jacket cooling fluid from an internal combustion engine and the second source of heat energy is exhaust gas from an internal combustion engine.

18. The system of claim 17 further comprising valves to allocate the heat energy available from the jacket cooling fluid into said first portion and second portion of heat energy.

19. The system of claim 17 wherein said first portion and second portion of the heat energy from the jacket cooling fluid comprise in combination up to and including all of the heat energy available from the jacket cooling fluid.

20. The system of claim 17 such that up to and including all of the heat energy available from the jacket cooling fluid is communicated to the working fluid.

21. The system of claim 13 further comprising a third heat exchanger disposed between the first heat exchanger and the working fluid inlet of the first expander.

22. The system of claim 21 wherein the third heat exchanger is in heat energy receiving communication with a second source of heat energy.

23. The system of claim 22 wherein the temperature of the second source of heat energy is greater than the temperature of the first source of heat energy.

24. A system for generating power from heat comprising a closed loop working fluid circuit, the circuit comprising:

A. a first source of heat energy and a second source of heat energy;

B. a working fluid condenser comprising a working fluid inlet and a working fluid outlet;

C. one or more working fluid pump(s) in working fluid receiving communication with the outlet of the working fluid condenser;

D. a first expander and a second expander;

E. a first heat exchanger (i) in heat energy receiving communication with the first source of heat energy and (ii) in working fluid receiving communication with at least one of the one or more working fluid pumps;

F. a second heat exchanger (i) in heat energy receiving communication with the second source of heat energy, (ii) in working fluid receiving communication with the first heat exchanger, and (iii) in working fluid sending communication with the first expander;

G. a third heat exchanger (i) in heat energy receiving communication with the first source of heat energy, (ii) in working fluid receiving communication with at least one of the one or more working fluid pumps, and (iii) in working fluid sending communication with the second expander;

H. the first expander comprising (i) a working fluid inlet in working fluid receiving communication with the second working fluid heat exchanger, (ii) a rotating mechanical power output shaft, and (iii) a working fluid outlet;

I. the second expander comprising (i) a working fluid inlet in working fluid receiving communication with the working fluid outlet of the first expander, (ii) a rotating mechanical power output shaft, and (iii) a working fluid outlet in working fluid sending communication with the working fluid inlet of the condenser;

wherein the system is configured to a) communicate heat energy (i) from the first source of heat energy to a working fluid via the first and third working fluid heat exchangers and (ii) from the second source of heat energy via the second working fluid heat exchanger;

b) expand the working fluid in the first expander to generate mechanical power at the rotating mechanical power output shaft of the first expander;

c) further expand the working fluid in the second expander to generate mechanical power at the rotating mechanical power output shaft of the second expander;

d) cool the working fluid in the condenser; and e) communicate cooled working fluid from the condenser to the one or more heat exchangers via the one or more working fluid pumps.

25. The system of claim 24 where in the first expander and the second expander are independently rotatable.

26. The system of claim 24 where the rotating mechanical power output shaft of the first expander is separate from the rotating mechanical power output shaft of the second expander.

27. The system of claim 24 where the rotating mechanical power output shaft of the first expander, the rotating mechanical power output shaft of the second expander, or both said rotating mechanical power output shafts are in mechanical power output delivery communication with at least one of any of an electric power generator, a prime mover, a pump, a combustion engine, a fan, a turbine, or a compressor.

28. The system of claim 24 wherein at least one of the first expander and the second expander are screw expanders.

29. The system of claim 24 wherein the temperature of the second source of heat energy is greater than the temperature of the first source of heat energy.

30. The system of claim 24 wherein up to and including all of the heat energy available from the first source of heat energy is communicated to the working fluid via the first heat exchanger and the third heat exchanger.

31. The system of claim 24 wherein the first heat exchanger receives a first portion of heat energy from the first source of heat energy and the third heat exchanger receives a second portion of heat energy from the first source of heat energy.

32. The system of claim 31 further comprising valves to allocate the heat energy from the first source of heat energy into said first portion and second portion.

33. The system of claim 31 wherein said first portion and second portion of the heat energy from the first source of heat energy comprise in combination up to and including all of the heat energy available from the first source of heat energy.

34. The system of claim 24 wherein the first source of heat energy is jacket cooling fluid from an internal combustion engine and the second source of heat energy is exhaust gas from an internal combustion engine.

35. The system of claim 34 such that up to and including all of the heat energy available from said jacket cooling fluid is communicated to the working fluid.

36. The system of claim 34 wherein the first heat exchanger receives a first portion of heat energy from said jacket cooling fluid and the third heat exchanger receives a second portion of heat energy from said jacket cooling fluid.

37. The system of claim 36 further comprising valves to allocate the heat energy from said jacket cooling fluid into said first portion and second portion.

38. The system of claim 36 wherein said first portion and second portion of the heat energy from said jacket cooling fluid comprise in combination up to and including all of the heat energy available from said jacket cooling fluid.

39. A system for converting heat energy into mechanical power, the system comprising:

A. a working fluid;

B. more than one source of heat energy;

C. more than two heat exchangers, each heat exchanger configured to (i) receive heat energy from at least one of the more than one sources of heat energy and (ii) communicate said heat energy to the working fluid, wherein at least two of the more than two heat exchangers each receive a separate portion of heat energy from the same source of heat energy;

D. more than one mechanically independently expander, wherein each expander comprises a working fluid outlet, further comprises a working fluid inlet in working fluid receiving communication with at least one of the more than two heat exchangers, and is configured to convert energy in the working fluid into mechanical power, and wherein the working fluid outlet of at least one of the more than one expanders is in working fluid sending communication with the working fluid inlet of at least one other of the more than one expanders;

E. at least one working fluid condenser in working fluid receiving communication with at least one of the more than one working fluid expanders; and F. one or more working fluid pump(s) in working fluid receiving communication with the condenser and in working fluid sending communication with the more than two heat exchangers.

40. The system of claim 39 wherein all of the available heat energy from at least one of the more than one sources of heat energy is communicated to the working fluid via the more than two heat exchangers.

41. The system of claim 39 where at least a portion of the mechanical power from at least one of the more than one expanders is communicated to at least one of any of an electric power generator, a prime mover, a pump, a combustion engine, a fan, a turbine, or a compressor.

42. The system of claim 39 where the temperature of one of the more than one sources of heat is greater than the temperature of at least one other of the more than one sources of heat.

43. The system of claim 39 wherein at least one of the more than one mechanically independently expanders is a screw expander.

* * * * *